United States Patent [19]

Tanczyn

[11] 3,969,109

[45] July 13, 1976

[54] OXIDATION AND SULFIDATION RESISTANT AUSTENITIC STAINLESS STEEL

[75] Inventor: Harry Tanczyn, Baltimore, Md.

[73] Assignee: Armco Steel Corporation, Middletown, Ohio

[22] Filed: Aug. 12, 1974

[21] Appl. No.: 496,583

[52] U.S. Cl. ..... 75/128 N; 75/128 A; 75/128 E; 75/128 G; 75/128 V; 75/128 W; 148/38

[51] Int. Cl.[2] ..... C22C 38/58

[58] Field of Search ..... 75/128 A, 128 N, 128 E, 75/128 W, 128 G, 128 V; 148/38

[56] References Cited

UNITED STATES PATENTS

| | | | |
|---|---|---|---|
| 2,393,778 | 1/1946 | Hull | 75/128 N |
| 2,438,824 | 3/1948 | Rich | 75/128 N |
| 3,554,736 | 1/1971 | Kusaka et al. | 75/128 N |
| 3,567,434 | 3/1971 | Richardson et al. | 75/128 N |
| 3,592,635 | 7/1971 | Hatano et al. | 75/128 N |

FOREIGN PATENTS OR APPLICATIONS

| | | | |
|---|---|---|---|
| 47-35642 | 4/1968 | Japan | 75/128 N |

OTHER PUBLICATIONS

"Phase Relationships in the Fe–Cr–Ni–N System," Tisinai, et al., Trans. ASM, vol. 51, 1957.

*Primary Examiner*—Arthur J. Steiner
*Attorney, Agent, or Firm*—Melville, Strasser, Foster & Hoffman

[57] ABSTRACT

An austenitic stainless steel which in solution treated condition exhibits excellent strength, hardness, and resistance to oxidation and sulfidation at elevated temperature, comprises from about 0.20 to about 0.50% carbon, about 0.01 to about 3.0% manganese, about 18 to about 35% chromium, about 0.01 to about 15% nickel, about 0.30 to about 1.0% nitrogen, about 0.10% maximum phosphorus, about 0.40% maximum sulfur, about 2% maximum silicon, up to about 0.75% cerium, and remainder substantially iron. Manganese is preferably restricted to a maximum of about 2.5% in combination with a preferred minimum chromium content of 21%. The steel has particular utility for fabrication into valves and valve parts for high performance diesel engines and gasoline engines, wherein exhaust valve temperatures are encountered within the range of about 1100° to about 1600° F and higher.

8 Claims, No Drawings

OXIDATION AND SULFIDATION RESISTANT AUSTENITIC STAINLESS STEEL

BACKGROUND OF THE INVENTION

1. Field of the Invention

This invention relates to an austenitic stainless steel useful for diesel and gasoline engine valves which provides the novel combination of excellent strength, hardness, resistance to oxidation and resistance to sulfidation at temperatures of 1100°F and higher.

2. The Prior Art

Among the steels currently used for diesel and gasoline engine valves are those sold under the registered trademark ARMCO 21-4N, 21-2N, 21-12N, Silchrome 10, INCO 751, and N-155. A recent experimental alloy developed by Crucible Steel Co., designated as DV-2B, has undergone testing.

ARMCO 21-4N and 21-2N steels, and modifications thereof, are disclosed in U.S. Pat. Nos. 2,495,731; 2,603,738; 2,657,130; 2,671,726; Re. 24,431; 2,839,391 and 3,149,965. In broad ranges these alloys comprise 0.08 to 1.5% carbon, 3 to 20% manganese, 12 to 30% chromium, 2 to 35% nickel, up to 0.6% nitrogen, and balance substantially iron. Modifications include a low-silicon type, a molybdenum-containing type, a boron-containing type, a high-silicon type and a high-phosphorus type. The commercial 21-4N alloy has a nominal analysis of about 0.5% carbon, 9.0% manganese, 21% chromium, 3.75% nickel, 0.45% nitrogen, and balance substantially iron.

Silchrome 10 has a nominal analysis of about 0.4% carbon, 1% manganese, 20% chromium, 8% nickel, 3% silicon, residual nitrogen, and balance substantially iron.

INCO 751 has a nominal analysis of about 0.1% carbon, 1.0% manganese, 15.5% chromium, 72% nickel, residual nitrogen, 1% columbium, 2.3% titanium, 1.2% aluminum, and balance substantially iron.

N-155 has a nominal analysis of about 0.1% carbon, 1.5% manganese, 21chromium, 20% nickel, 0.15% nitrogen, 19.5% cobalt, 2.95% molybdenum, 1.15% columbium, 2.35% tungsten, and balance substantially iron.

Crucible DV-2B has a nominal analysis of about 0.5% carbon, 12% manganese, 21% chromium, 1% silicon, 0.45% nitrogen, 1% columbium, 2% tungsten, 0.4% vanadium, and balance substantially iron.

While several of these prior art alloys perform satisfactorily as diesel engine valves at temperatures below about 1300°F, none has proven entirely satisfactory as a valve material in high performance diesel engines wherein exhaust valve temperatures range from about 1500° to 1650°F, and wherein valves are exposed to sulfide-containing fuels and lubricants. For example, ARMCO 21-4N, 21-2N and 21-12N have been found to lack adequate oxidation resistance and high temperature strength. INCO 751, while possessing good oxidation resistance and high temperature strength and hardness, has extremely poor sulfidation resistance. Silchrome 10 exhibits adequate oxidation resistance but relatively poor high temperature strength and sulfidation resistance. N-155 has good oxidation resistance, strength and hardness, and apparently has adequate sulfidation resistance, but is extremely high in cost. Crucible DV-2B has poor high temperature strength and oxidation and sulfidation resistance.

Recent changes in the compositions of fuels and lubricants have resulted in a demand for a steel of reasonable cost which exhibits good sulfidation resistance, together with the usual requirements of strength, hardness and oxidation resistance at temperatures above 1300°F. From the above discussion of prior art alloys, it is apparent that such a steel is not now available.

SUMMARY

It is a principal object of the present invention to provide an austenitic stainless steel of reasonable cost by virtue of relatively low contents of expensive alloying elements, which in the solution treated condition exhibits the novel combination of strength, hardness, and excellent resistance to oxidation and sulfidation at temperatures of 1100°F and higher, and which can readily be fabricated into valves and valve parts for diesel and gasoline engines.

The above and other objects are achieved in an austenitic stainless steel in which critical percentage ranges of and critical balancing among the essential elements carbon, manganese, chromium and nitrogen are observed. In broad ranges the steel of the invention consists essentially of the following composition, by weight percent:

| | |
|---|---|
| carbon | about 0.20 to about 0.50% |
| manganese | about 0.01 to about 3.0% |
| chromium | about 18 to about 35% |
| nickel | about 0.01 to about 15% |
| nitrogen | about 0.30 to about 1.0% |
| phosphorus | about 0.10% maximum |
| sulfur | about 0.40% maximum |
| silicon | about 2% maximum |
| iron | remainder except for incidental impurities |

It has been discovered that the relatively high carbon and manganese contents of prior art valve steels such as Armco 21-4N and Crucible DV-2B were the principal causes of inadequate high temperature strength and poor resistance to sulfidation at temperatures above 1100°F. More specifically, high carbon levels on the order of 0.5% in prior art steels resulted in the formation of chromium carbide particles during heat treatment, precipitation of which caused removal of chromium atoms from the matrix metal at a ratio of 16 chromium atoms for each carbon atom (thereby lowering austenite stability and creep strength), and caused the chromium carbide particles to act as nucleation sites for thermal fatigue cracks (thereby lowering the high temperature fatigue strength). According to the present invention, a carbon level low enough to restrict insoluble carbides to less than about 1% volume fraction, when the steel is solution treated at about 2100° to 2175°F, has been found to solve the problems of inadequate high temperature creep strength and fatigue strength. Moreover, since lower carbon contents result in a greater amount of chromium remaining in solid solution (in view of the 16:1 ratio of removal of chromium atoms by carbon atoms), and since chromium increases the solubility of nitrogen in solid solution, it was found that the nitrogen content of the steel of the invention could be increased to a level substantially above that which could be tolerated in prior art valve steels, thereby providing still greater high temperature strength.

The relatively high manganese and chromium levels of Armco 21-4N were found to produce further adverse effects. When such a steel was heated to about 1400° to 1600°F, a brittle chromium-manganese compound was formed in the grain boundaries of the austenitic matrix resulting in a loss of creep strength. It was found that by restricting the manganese content to a maximum of 3% by weight, and preferably 2.5% or less, the formation of the brittle chromium-manganese compound could be prevented with consequent increase in high temperature creep strength. The low manganese of the steel of the invention provides the further benefit of permitting addition of a relatively high chromium level, preferably about 21 to about 30%, in order to increase high temperature oxidation resistance without formation of the brittle chromium-manganese compound.

In addition to improving high temperature strength and oxidation resistance, it has further been found that the above mentioned restriction of the manganese content and increase in the chromium content surprisingly resulted in a great improvement in sulfidation resistance at high temperature. Although not wishing to be bound by theory, it appears that the affinity of manganese for sulfur and sulfur-containing compounds accelerates sulfidation attack, and reduction of the manganese level thus increases sulfidation resistance.

The steel of this invention has been found to possess greatly improved resistance to stress corrosion cracking in halogen-containing environments, in comparison to the previously mentioned Armco 21-2N and 21-4N stainless steels. This is attributed to the restricted carbon range of about 0.20 to 0.50%, and the proportioning of carbon, chromium, and nickel.

It is therefore apparent that the carbon, manganese, chromium and nitrogen levels, and the inter-relation therebetween, are in every sense critical to attaining the novel combination of properties of the steel of the present invention.

DESCRIPTION OF THE PREFERRED EMBODIMENTS

A preferred composition, in which the above described inter-relation between carbon, manganese, chromium and nitrogen is observed, thereby resulting in a steel which in solution treated condition contains less than about 1% by volume of insoluble carbides and has excellent resistance to oxidation and sulfidation, together with strength and hardness at temperatures of 1100°F and higher, consists essentially of (by weight percent) from about 0.25 to about 0.45% carbon, about 0.01 to about 2.5% manganese, about 21 to about 30% chromium, about 2 to about 10% nickel, about 0.35 to about 0.55% nitrogen, about 0.10% maximum phosphorus, about 0.10% maximum sulfur, about 2% maximum silicon, and remainder substantially iron. For optimum resistance against sulfidation, the preferred composition may include up to about 0.75% cerium.

The elements nickel and silicon, while less critical than carbon, manganese, chromium and nitrogen with respect to percentage ranges and proportioning with other elements, nevertheless must be considered as critical in certain applications of the steel of the present invention. Thus for exhaust valves for gasoline engines wherein lead compounds are present in the environment, restriction of the silicon content to a maximum of 0.45% results in improved resistance to erosive attack by lead compounds. This relationship has previously been disclosed with respect to Armco 21-4N and has also been found to hold true for the steel of the present invention.

It has been found that silicon and nickel tend to restrict carbide solubility in the solid state and nitrogen solubility in the liquid state. Accordingly, in a more preferred composition, the nickel content is restricted to a maximum of about 8% to obtain optimum carbide and nitrogen solubility.

The maximum levels of phosphorus and sulfur are restricted to 0.04 and 0.03%, respectively, together with a maximum of 0.45% silicon and a maximum of about 8% nickel in the more preferred composition.

A more preferred composition according to the present invention, which results in an optimum combination of properties in the solution treated condition, consists essentially of (by weight percent) from about 0.25 to about 0.45% carbon, about 0.01 to about 2.0% manganese, about 23 to about 26% chromium, about 4 to about 8% nickel, about 0.35 to about 0.55% nitrogen, about 0.04% maximum phosphorus, about 0.03% maximum sulfur, about 0.45% maximum silicon, and remainder substantially iron, with the nitrogen to carbon weight ratio at least about 1:1.

Although the criticality of restricting the carbon content to a maximum of 0.50% and preferably to a maximum of about 0.45% has been emphasized above, a minimum of at least about 0.20% carbon is essential in order to produce a precipitation-hardening and strengthening reaction at the anticipated service temperature range for exhaust valve materials, i.e. about 1100° to about 1650°F. Carbon is restricted to a level which can be substantially completely dissolved by heat treatment in the solid state, i.e. a maximum of about 0.5%. Greater than 0.5% carbon results in difficulty in hot working, welding and machining, decreased ductility at room temperature and decreased stress corrosion resistance. From the standpoint of metallurgical stability of solution-treated and age-hardened martensite, the destabilizing influence of low carbon can be counterbalanced by increased nickel and/or nitrogen levels. It has further been found that the strengthening effects of carbide precipitates vary directly with volume fraction of carbides and inversely with carbide particle size. Accordingly, a broad range of about 0.20 to about 0.50% carbon, preferably about 0.25 to about 0.45%, must be observed.

Age hardening has been found to be associated with the nitrogen:carbon ratio. A nitrogen to carbon weight ratio of about 1:1 or higher causes a definite change in the extent of age hardening and raises the temperature at which overaging, i.e. softening reaction, occurs. Accordingly, although not critical, nitrogen is preferably proportioned directly to the more preferred carbon contents set forth above, with the more preferred nitrogen range about 0.35 to about 0.55%, and a nitrogen:carbon ratio of at least about 1:1, for optimum elevated temperature hardness and strength.

The critical inter-relation between manganese and chromium has been pointed out above. Since the steel of the present invention contemplates very low manganese levels in the broad range, i.e. as low as about 0.01%, a minimum of about 18% chromium has been found to be sufficient to provide the necessary high temperature oxidation resistance. A preferred maximum of about 2.5% manganese must be observed for optimum high temperature creep strength and sulfidation resistance. With the preferred maximum manganese level of about 2.5%, the preferred chromium range is 21 to 30%, with the more preferred maximum manganese of 2.0% the more preferred chromium range is 23 to 26% by weight. A maximum of about 35% chromium must be observed in order to avoid upsetting the austenitic balance of the steel of the invention.

It has also been found that cerium may be added to the steel of the invention in amounts up to about 0.75% in order to obtain still greater sulfidation resistance. Although cerium has the same great affinity for sulfur as manganese, the cerium addition has been found to reduce sulfidation attack, contrary to the action of high manganese. This anomalous behavior by cerium is believed to be due to its ability to combine with sulfur to form an adherent surface film of cerium sulfide, acting as a barrier which precludes further reaction of sulfur in the atmosphere or environment surrounding the valve with the underlying base metal.

Sulfur may be added for machinability, and for this reason a maximum of about 0.4% sulfur may be present in the broad composition. When not added for this purpose sulfur is preferably restricted to a maximum of about 0.1%, and more preferably to a maximum of about 0.03%. When cerium (or a mixture of rare earth metals, such as mischmetal) is to be added, the more preferred maximum of about 0.03% sulfur should be observed.

Molybdenum may be added to the steel of the invention in amounts up to about 4% for increased resistance to lead oxide corrosion and for enhanced high temperature strength. Tungsten can replace molybdenum in amounts up to 3% where increased resistance to lead oxide corrosion is not needed and where greater high temperature strength is desired.

Columbium, vanadium, or mixtures thereof, may be added in amounts up to about 2% total for refinement of the grain size of the steel, with consequent increase in high temperature strength.

While the steel of this invention has been found to exhibit properties which make it suitable for use in high performance diesel engines where temperatures up to 1650°F are encountered, the relatively low cost of the present steel also makes it competitive with prior art materials which are suitable only for light duty diesel engine valves, the operating temperatures of which range from about 1100° to about 1300°F. Moreover, in applications other than engine valves, the mechanical and erosion-resistant properties of the steel of the invention make it suitable for use at temperatures up to 2000° to 2100°F.

A series of steels in accordance with the invention has been subjected to comparative tests with similar steels outside the invention and a number of prior art valve steels, viz. Armco 21-4N, 21-2N, 21-12N, Silchrome-10 and INCO- 751. The compositions of the steels subjected to testing are set forth in TABLE I below:

TABLE I

| | Compositions | | | | | | | | | |
|---|---|---|---|---|---|---|---|---|---|---|
| Heat | C | Mn | Cr | Ni | N | P | S | Si | Ce | |
| 8887-1 | .59 | 2.70 | 24.83 | 4.30 | .24 | .025 | .015 | .24 | none | |
| 8887-2 | .58 | 2.68 | 24.78 | 4.32 | .26 | .024 | .014 | .27 | .05 | |
| 8888-1 | .35 | 8.31 | 20.93 | 4.43 | .46 | .008 | .014 | .08 | none | |
| 8888-2 | .38 | 8.25 | 20.78 | 4.40 | .45 | .009 | .012 | .06 | .05 | |
| 8889-3 | .45 | 7.28 | 21.96 | 4.44 | .42 | .009 | .012 | .07 | .20 | |
| 8897 | .42 | 8.32 | 23.31 | 6.69 | .41 | .016 | .010 | .15 | none | |
| 8918 | .45 | 8.97 | 29.89 | 6.57 | .62 | .013 | .013 | .59 | none | |
| 8927* | .38 | 1.92 | 21.73 | 6.34 | .31 | .006 | .014 | .34 | none | |
| 8928* | .38 | 1.93 | 25.69 | 6.48 | .38 | .007 | .014 | .34 | none | |
| 8929* | .39 | 1.90 | 29.97 | 6.56 | .49 | .009 | .015 | .35 | none | |
| 033040* | .35 | 1.81 | 24.50 | 5.83 | .42 | .012 | .011 | .29 | none | |
| 033041 | .35 | 9.00 | 20.62 | 3.72 | .48 | .010 | .011 | .17 | none | |
| 8967* | .40 | .15 | 21.72 | 6.67 | .37 | .029 | .020 | .48 | none | Mo 2.04 |
| 8968* | .41 | 1.74 | 21.93 | 6.68 | .35 | .027 | .017 | .57 | none | Mo 2.04 |
| 8969* | .40 | 1.87 | 21.93 | 6.74 | .36 | .027 | .017 | .64 | .05 | Mo 2.03 |
| 8974* | .38 | 1.72 | 21.98 | 6.78 | .30 | .026 | .016 | .57 | none | MO 1.89<br>Cb .29 |
| 8975* | .41 | 1.81 | 22.23 | 6.60 | .35 | .017 | .016 | .53 | none | Cb .29 |
| 8976* | .40 | 1.83 | 22.03 | 8.79 | .30 | .016 | .014 | .50 | none | |
| 8977* | .32 | 1.84 | 24.76 | 5.83 | .34 | .017 | .017 | .56 | none | |
| 8978 | .30 | 3.68 | 24.65 | 5.87 | .49 | .017 | .014 | .60 | none | |
| 8979 | .44 | 4.55 | 23.53 | 1.98 | .42 | .023 | .014 | .31 | none | |
| 8980* | .44 | 2.84 | 23.49 | 1.98 | .30 | .020 | .017 | .39 | none | |
| 8981 | .39 | 4.73 | 23.41 | 4.02 | .45 | .022 | .014 | .32 | none | |
| 8982* | .40 | 2.86 | 23.39 | 4.08 | .44 | .018 | .017 | .42 | none | |
| 8983* | .39 | 1.89 | 20.09 | 6.18 | .30 | .011 | .018 | 1.51 | none | |
| 9011* | .36 | 1.81 | 22.40 | 10.28 | .33 | .019 | .014 | .55 | none | |
| 9012* | .34 | 1.82 | 21.86 | 11.95 | .30 | .019 | .016 | .59 | none | |
| 9013* | .35 | 1.80 | 22.40 | 8.69 | .36 | .020 | .015 | .60 | none | Cb .28 |
| 9014* | .37 | 1.85 | 22.28 | 10.88 | .37 | .019 | .015 | .65 | none | Cb .29 |
| 9015* | .37 | 1.92 | 22.39 | 6.67 | .39 | .018 | .013 | .58 | none | Cb .14<br>V .12 |
| 9016* | .39 | 1.82 | 22.26 | 6.74 | .40 | .021 | .014 | .62 | none | Cb .13<br>V .12<br>W 2.94 |
| 546035* | .34 | 2.32 | 24.68 | 5.44 | .39 | .022 | .022 | .20 | .05 | V .10 |
| 21-4N | .52 | 9.0 | 20.92 | 3.48 | .42 | .027 | .052 | .15 | none | |
| 21-2N | .55 | 8.08 | 20.37 | 1.76 | .34 | .028 | .048 | .17 | none | |
| 21-12N | .21 | 1.28 | 21.25 | 11.92 | .22 | .018 | .015 | .72 | none | |
| Silchr.-10 | .39 | 1.10 | 19.29 | 8.14 | .03 | .022 | .019 | 3.14 | none | |
| INCO-751 | .04 | .21 | 15.35 | 70.95 | — | .007 | .005 | .23 | none | Ti 2.43;<br>Al 1.23;<br>Cb .98 |

*Steels of the present invention

Test data regarding air oxidation and sulfidation resistance of representative heats of Table I are set forth in Table II. In this Table, all test values were averages of results with duplicate specimens, and all specimens were subjected to solution treatment at 2100°F for 1 hour, water quenched, plus 1400°F for 16 hours and air cooled. The air oxidation test and the sulfidation test were as follows:

Air Oxidation

Specimens 2½ inches long by 0.500 inch diameter were heated for 100 hours in an electric muffle, still air furnace.

Sulfidation 0.500 inch long by 0.500 inch diameter specimens were placed in a magnesium oxide crucible with a mixture of 90% sodium sulfate and 10% sodium chloride, and heated at 1700°F for 1 hour. Each specimen was then cleaned and the weight loss was determined.

It will be noted that Heats 8927, 033040, 8928 and 8929, steels of the invention, illustrate progressively increasing resistance against air oxidation and sulfidation with progressively increasing chromium contents, ranging from 21.73% for Heat 8927 to 29.97% for Heat 8929.

The air oxidation resistance of the above heats of steels of the invention at 1600°F was superior to that of Armco 21-4N and 21-2N, and comparable to that of 21-12N and Silchrome-10. While the oxidation resistance of these heats is somewhat inferior to that of INCO-751, it is of great significance to note the marked improvement in sulfidation resistance of the steels of the invention in comparison to the extremely high weight loss undergone by INCO-751 in the sulfidation test. The preferred steels of the invention are also markedly superior to Armco 21-4N, 21-2N and Silchrome-10 in sulfidation resistance.

The data of Table II further show the criticality of the manganese content with respect to sulfidation resistance and high temperature creep strength. Heats 8967, 8969, 8980, 8982, 8978, 8979, and 8981 have gradually increasing manganese contents of 0.15%, 1.87%, 2.84%, 2.86%, 3.68%, 4.55%, 4.73%, respectively. The sulfidation test results for these respective heats are 0.322, 0.302, 0.399, 0.323, 0.408, 0.442, and 0.461. Since a value of 0.400 for the 90–10 sulfidation test is considered the maximum acceptable level, it is apparent that the critical manganese level is slightly above that of heat 8982 (2.86% manganese) which exhibited a value of 0.323, whereas heat 8978 (3.68% manganese) exhibited a value of 0.408.

A comparison of heats 8929 and 033040, preferred compositions having a best combination of properties, with heat 8983 having a comparable manganese level below the preferred maximum of 2.5% but a chromium content below the preferred minimum of 21% and a silicon content above the more preferred maximum of 0.45%, shows the beneficial effects on both sulfidation resistance and oxidation resistance resulting from the combination of low manganese and high chromium.

TABLE II

| Heat | Air-Oxidation & Sulfidation Weight Loss-Grams/Decimeter² 100 Hr. Air-Oxidation 1400° | 1500° | 1600° | Sulfidation 1700° | % Mn | % Cr |
|---|---|---|---|---|---|---|
| 8887-1 | .094 | .193 | .482 | .320 | 2.70 | 24.83 |
| 8887-2 | .075 | .176 | .419 | .270 | 2.68 | 24.78 |
| 8888-1 | .201 | .409 | .798 | .590 | 8.31 | 20.93 |
| 8888-2 | .173 | .309 | .687 | .485 | 8.25 | 20.78 |
| 8889-3 | .146 | .288 | .640 | .410 | 7.28 | 21.96 |
| 8897 | .097 | .211 | .470 | .595 | 8.32 | 23.31 |
| 8918 | .057 | .140 | .413 | .445 | 8.97 | 29.89 |
| 8927* | .174 | .375 | .692 | .370 | 1.92 | 21.73 |
| 8928* | .078 | .179 | .462 | .191 | 1.93 | 25.69 |
| 8929* | .043 | .130 | .372 | .110 | 1.90 | 29.97 |
| 033040* | .082 | .189 | .456 | .185 | 1.81 | 24.50 |
| 033041 | .185 | .371 | .762 | .610 | 9.00 | 20.62 |
| 8967* | .168 | .364 | .684 | .322 | .15 | 21.72 |
| 8968* | .177 | .380 | .702 | .267 | 1.74 | 21.93 |
| 8969* | .155 | .298 | .608 | .302 | 1.87 | 21.93 |
| 8974* | .184 | .397 | .743 | .376 | 1.72 | 21.98 |
| 8975* | .188 | .373 | .718 | .355 | 1.81 | 22.23 |
| 8976* | .164 | .352 | .697 | .382 | 1.83 | 22.03 |
| 8977* | .096 | .194 | .482 | .197 | 1.84 | 24.76 |
| 8978 | .102 | .223 | .517 | .408 | 3.68 | 24.65 |
| 8979 | .128 | .274 | .613 | .442 | 4.55 | 23.53 |
| 8980* | .101 | .205 | .492 | .339 | 2.84 | 23.49 |
| 8981 | .154 | .311 | .647 | .461 | 4.73 | 23.41 |
| 8982* | .096 | .201 | .508 | .323 | 2.86 | 23.39 |
| 8983* | .092 | .253 | .562 | .524 | 1.89 | 20.09 |
| 546035* | .075 | .167 | .406 | .132 | 2.32 | 24.68 |
| 21-4N | .193 | .381 | .749 | .545 | 9.0 | 20.92 |
| 21-2N | .182 | .348 | .717 | .740 | 8.08 | 20.37 |
| 21-12N | — | .291 | .614 | .388 | 1.28 | 21.24 |
| Silchr.-10 | — | .224 | .508 | .672 | 1.10 | 19.28 |
| INCO-751 | — | .095 | .295 | 10.655 | .21 | 15.35 |

*Steels of the present invention

TABLE III

| Heat | Creep Strength and Age-Hardening Load for 1% Stretch In 100 Hours-psi 1500°F | 1600°F | Rockwell Hardness 250°F-1hr-W.Q. | +1400°F-16hrs-A.C. | N/C | N+C |
|---|---|---|---|---|---|---|
| 8887-1 | 10,500 | | | | .41 | .83 |
| 8887-2 | 10,750 | | | | .45 | .84 |
| 8888-1 | 8.700 | | | | 1.31 | .81 |

TABLE III-continued

| Heat | Load for 1% Stretch In 100 Hours-psi 1500°F | 1600°F | Creep Strength and Age-Hardening Rockwell Hardness 250°F-1hr-W.Q. | +1400°F-16hrs-A.C. | N/C | N+C |
|---|---|---|---|---|---|---|
| 8888-2 | 8,550 | | | | 1.18 | .83 |
| 8889-3 | 9,100 | | | | .93 | .87 |
| 8997 | 8,250 | | | | .98 | .83 |
| 8918 | 7,250 | | | | 1.38 | 1.07 |
| 8927* | 11,850 | | | | .82 | .69 |
| 8928* | 12,300 | | | | 1.0 | .76 |
| 8929* | 13,000 | | | | 1.26 | .88 |
| 033040* | 12,350 | 8,000 | C26 | C35 | 1.20 | .77 |
| 033041 | | | C27 | C39 | 1.37 | .83 |
| 8967* | 11,200 | | | | .93 | .77 |
| 8968* | 11,200 | | | | .88 | .76 |
| 8969* | 11,800 | | | | .90 | .76 |
| 8974* | 12,700 | | | | .79 | .68 |
| 8975* | 12,200 | | | | .85 | .76 |
| 8976* | 10,800 | | | | .75 | .70 |
| 8977* | 9,800 | | | | 1.06 | .66 |
| 8978 | 7,500 | | | | 1.63 | .79 |
| 8983* | 11,000 | 7,600 | | | .77 | .69 |
| 9012* | 10,200 | 6,900 | | | .88 | .64 |
| 9016* | 13,000 | 9,000 | | | 1.03 | .79 |
| 21-4N | 9,500 | 3,500 | C27 | C39 | .81 | .94 |
| 21-2N | 9,100 | 3,100 | | | .62 | .89 |
| 21-12N | 9,100 | 3,000 | B95 | B97 | 1.05 | .43 |
| Silchrome-10 | 8,200 | 2,500 | C22 | C24 | .08 | .42 |
| INCO-751 | 24,000 | 14,000 | | | | |

*Steels of the present invention

Table III contains test data showing the high creep strength of the steels of the invention in comparison to Armco 21-4N, 21-2N, 21-12N and Silchrome-10. The improved creep strength is believed to be due to the elevated-temperature stability of the solution-treated and age-hardened austenitic matrix. Excess carbon in the form of insoluble carbides lowers the matrix chromium content at a ratio of about 16:1 (i.e. 0.10% insoluble carbide combines with 1.6% chromium) resulting in lower austenite stability and creep strength particularly at temperatures above 1500°F. In addition, as explained previously, a high sum total of manganese and chromium levels causes precipitation of a chromium-manganese compound as an inter-granular phase during exposure at 1500° to 1600°F. This inter-metallic compound also lowers the creep strength of the austenitic matrix.

It will be further noted that Table III illustrates the association of carbon and nitrogen contents in age-hardening. Armco 21-12N, with a total of 0.43% carbon plus nitrogen, produced no significant age-hardening response at 1400°F, despite a nitrogen to carbon ratio of 1.05. Silchrome-10, with a combined carbon and nitrogen level of 0.42% exhibited only a slight age-hardening response at 1400°F. In this instance, the slight response was attributed to the low nitrogen to carbon ratio of 0.08. Definite age hardening at 1400°F was exhibited by Armco 21-4N and by the steels of the invention.

A comparison of heats 8978, 8977, 033040 and 8929, wherein carbon is 0.30%, 0.32%, 0.35% and 0.39%, respectively, shows that an increase in the carbon content increases high temperature mechanical strength irrespective of the nitrogen to carbon ratio, provided the sum total of nitrogen plus carbon is at least about 0.60%. Heat 9016 shows the beneficial effect of tungsten in increasing high temperature strength.

Accordingly, although a nitrogen to carbon weight ratio of at least about 1:1 and a sum total of carbon plus nitrogen contents ranging from about 0.60 to about 0.90% is preferred for a best combination of other properties, a minimum of about 0.35% carbon is needed for optimum high temperature mechanical strength. Both the creep strength and age-hardening response of the steel of the invention are definitely superior to those of Armco 21-4N despite the sum total of carbon plus nitrogen contents of 0.94% in 21-4N.

Table IV sets forth a comparison of the mechanical properties of a steel of the invention (heat 033040) with those of Armco 21-4N, at temperatures ranging from 75° to 1600°F. It will be noted that the superiority of 21-4N in ultimate tensile strength and 0.2% tensile yield strength at lower temperatures is overcome at 1400° and 1600°F, where the steel of the invention exhibited substantially higher values than 21-4N. The percent elongation and percent reduction of area values of the steel of the invention remained relatively constant at 1200°, 1400° and 1600°F, whereas 21-4N exhibited an increase in these values, this behavior indicating metallurgical instability at elevated temperature.

TABLE IV

| Heat | Test Temp°F | U.T.S. ksi | Mechanical Properties 0.2% T Y.S. ksi | % Elong. in4XD | % Redn. Area | Brinell Hardness Cold-ball Method |
|---|---|---|---|---|---|---|
| 033040* | 75 | 151.2 | 97.1 | 15.0 | 11.0 | 363 |
| 21-4N | 75 | 165.2 | 101.7 | 18.5 | 9.8 | 352 |
| 033040* | 800 | 111.3 | 56.3 | 29.3 | 34.1 | — |
| 21-4N | 800 | 119.0 | 61.5 | 18.0 | 19.2 | — |
| 033040* | 1000 | 99.9 | 51.6 | 24.3 | 28.0 | — |
| 21-4N | 1000 | 102.0 | 54.2 | 16.0 | 20.0 | — |
| 033040* | 1200 | 85.8 | 44.5 | 17.9 | 24.2 | — |

TABLE IV-continued

| Heat | Test Temp°F | U.T.S. ksi | 0.2% T Y.S. ksi | % Elong. in4XD | % Redn. Area | Brinell Hardness Cold-ball Method |
|---|---|---|---|---|---|---|
| | | Mechanical Properties | | | | |
| 21-4N | 1200 | 85.1 | 46.3 | 15.2 | 21.8 | — |
| 033040* | 1400 | 68.4 | 42.2 | 17.9 | 25.8 | 190 |
| 21-4N | 1400 | 60.7 | 35.4 | 19.3 | 24.6 | 190 |
| 033040* | 1600 | 47.2 | 32.4 | 17.1 | 24.4 | 182 |
| 21-4N | 1600 | 36.8 | 23.5 | 29.5 | 41.2 | 177 |

*Steel of Invention heat treated 2175°F-1hr-W.Q. +1400°F-16-hrs-A.C.
21-4N heat treated 2150°F-1hr-W.Q. +1400°F-16hrs-A.C.

Room temperature mechanical properties of representative steels of the invention, together with those of two similar steels outside the invention (by reason of manganese contents above the maximum of 3.0%), are set forth in Table V. It will be noted that Heat 8974, a steel of the invention containing molybdenum and columbium, exhibited relatively high tensile and yield strengths in combination with good ductility, as compared to Heats 8981 and 8982. All specimens were in the solution treated condition, which comprised heating at 2150°F for 40 minutes, water quenching, heating at 1500°F, for 16 hours and water quenching.

TABLE V

| Heat | U.T.S. ksi | 0.2% T. Y.S.-ksi | % Elong. In 4X D | % Reduction Area |
|---|---|---|---|---|
| | Mechanical Properties - Room Temperature | | | |
| 8974* | 146 | 84.4 | 24.0 | 25.5 |
| 8975* | 141 | 77.4 | 26.5 | 29.0 |
| 8976* | 140.8 | 76.5 | 24.5 | 31.8 |
| 8977* | 138.6 | 81.2 | 18.0 | 14.0 |
| 8978 | 145 | 80.2 | 21.0 | 22.0 |
| 8981 | 148.8 | 86.9 | 12.5 | 11.0 |
| 8982* | 148.6 | 89.5 | 7.5 | 6.0 |
| 8983* | 145 | 79.5 | 12.0 | 9.8 |

*Steels of the present invention

Lead oxide corrosion tests have been conducted and are summarized in Table VI. Two examples of steels of the invention (Heat 033040 containing 0.29% silicon, and Heat 546035, a cerium treated arc furnace heat containing 0.20% silicon) were compared with several prior art steels. It will be noted that if the steel of the invention is restricted to a maximum of about 0.2% silicon, resistance to weight loss by lead oxide corrosion is comparable to that of the best prior art alloy (INCO-751), slightly superior to Armco 21-4N and markedly superior to Armco 21-12N and Silchrome-10. Good resistance to lead oxide corrosion is obtained by the steel of the invention at a silicon content of 0.45% or less, as evidenced by Heat 033040.

TABLE VI

| Heat | Lead Oxide Corrosion Test 1675°F - 1 Hour Weight Loss-grams/decimeter²/hour |
|---|---|
| 033040* | 25 |
| 546035* | 18 |
| Armco 21-4N | 25 |
| Armco 21-12N | 40 |
| Silchrome-10 | 45 |
| INCO-751 | 12 |

*Steels of the present invention

The steel of the invention is melted by any conventional process, and may be remelted in vacuum, atmosphere and slag-protection procedures. After casting into ingots or slabs the steel can easily be worked with conventional equipment into plate, sheet, strip, bar or rod. Such wrought products can be readily fabricated into articles of ultimate use such as valves and valve parts, due to the restricted carbon level of the steel. The invention thus contemplates valves and valve parts for diesel and gasoline engines fabricated from an austenitic stainless steel which has been solution treated at 2100° to 2175°F and water-quenched, the valves and valve parts having less than 1% by volume of insoluble carbides, excellent strength, hardness and resistance to oxidation and sulfidation at temperatures of 1100° to 1600°F and good resistance against corrosion cracking in halogen-containing environments, said steel consisting essentially of (by weight percent) from about 0.25 to about 0.45% carbon, about 0.01 to about 2.5% manganese, about 21 to about 30% chromium, about 2 to about 10% nickel, about 0.35 to about 0.55% nitrogen, about 0.10% maximum phosphorus, about 0.10% maximum sulfur, about 2% maximum silicon, and remainder iron except for incidental impurities.

For applications where the valves require resistance to erosive attack by lead compounds in gasoline engine exhaust gases, the above composition should be modified by restricting the silicon content to a maximum of 0.45% and more preferably to a maximum of 0.2%. For optimum resistance against sulfidation, the above composition may further include up to about 0.75% cerium.

The steel of the invention further exhibits great utility in the form of bar and wire which is to be subjected to extensive machining operations while still retaining good strength, hardness and resistance to oxidation at temperatures up to about 2000°F, together with good resistance against stress corrosion cracking. Such a preferred steel consists essentially of, by weight percent, from about 0.25 to about 0.45% carbon, about 0.01 to about 2.5% manganese, about 21 to about 30% chromium, about 2 to about 10% nickel, about 0.30 to about 0.55% nitrogen, about 0.10% maximum phosphorus, up to about 0.40% sulfur, about 2% maximum silicon, and remainder iron except for incidental impurities. For optimum mechanical strength at elevated temperatures this composition should be restricted to a maximum of about 0.45% silicon and may contain molybdenum and/or tungsten, columbium, or vanadium, in amounts hereinabove specified. Such a steel is suited to applications other than engine valves where a maximum useful service temperature range of about 2000° to 2100°F is needed.

The term cerium used hereinabove and in the appended claim is intended to cover cerium, mixtures of rare earth metals containing a major proportion of cerium, or mischmetal.

In summary, it will be apparent that the steel of this invention, and products fabricated therefrom, possess in combination, excellent strength, hardness, resistance to oxidation and sulfidation at elevated temperature, good resistance against lead oxide corrosion, and good stress corrosion resistance, when in the solution treated condition. More specifically, preferred steels of the invention exhibit a weight loss, in grams per square decimeter, of not greater than 0.400 at 1500°F by the 100 hour air-oxidation test described herein, and not greater than 0.400 by the 90–10 sulfidation test described herein. These steels further exhibit stress elongation values for 1% stretch in 100 hours at 1500°F of greater than 9,500 psi. The more preferred steels of the invention exhibit a weight loss of not greater than about 0.200 at 1500°F (not greater than about 0.500 at 1600°F) by that 100 hour air oxidation test, not greater than 0.200 by that 90–10 sulfidation test, and a stress elongation value of at least about 11,000 psi.

When restricted to a maximum of 0.45% silicon, preferred steels of the invention exhibit a weight loss not exceeding about 30 grams per square decimeter per hour when subjected to lead oxide corrosion testing at 1675°F.

To the best of applicant's knowledge no prior art alloy meets all the above requirements. Moreover, the properties are achieved in a steel which is competitive in manufacturing cost with the lowest-cost prior art materials suitable for light duty diesel engine valves and valve parts.

While the invention has been disclosed with reference to preferred embodiments, modifications may be made without departing from the spirit and scope of the invention, and no limitations are to be inferred or implied except insofar as specifically set forth in the claims which follow;

The embodiments of the invention in which an exclusive property or privilege is claimed are defined as follows:

1. An austenitic stainless steel which in solution treated condition contains less than about 1% by volume of insoluble carbides, exhibits a weight loss of not greater than 0.400 grams per square decimeter at 1500°F by the 100 hour air-oxidation test described herein, a weight loss of not greater than 0.400 grams per square decimeter at 1700°F by the 90–10 sulfidation test described herein, a stress elongation of greater than 9500 psi for 1% stretch in 100 hours at 1500°F, and good resistance against stress corrosion cracking in halogen-containing environments, said steel consisting essentially of, by weight percent, from about 0.25 to about 0.45% carbon, about 0.01 to about 2.5% manganese, about 21 to about 30% chromium, about 2 to about 10% nickel, about 0.35 to about 0.55% nitrogen, about 0.10% maximum phosphorus, about 0.10% maximum sulfur, about 2% maximum silicon, and remainder iron, except for incidental impurities.

2. The steel of claim 1, including up to about 0.75% cerium.

3. An austenitic stainless steel which in solution treated condition has a weight loss of not greater than 0.200 grams per square decimeter at 1500°F by the 100 hour air-oxidation test described herein, a weight loss of not greater than 0.200 grams per square decimeter at 1700°F by the 90–10 sulfidation test described herein, and a stress elongation of at least about 11,000 psi for 1% stretch in 100 hours at 1500°F, said steel consisting essentially of, by weight percent, from about 0.25 to about 0.45% carbon, about 0.01 to about 2.0% manganese, about 23 to about 26% chromium, about 4 to about 8% nickel, about 0.35 to about 0.55% nitrogen, about 0.04% maximum silicon, and remainder iron, except for incidental impurities, with the nitrogen to carbon weight ratio at least about 1:1.

4. The steel of claim 1, including up to about 3% tungsten.

5. The steel of claim 1, including up to about 4% molybdenum.

6. The steel of claim 1, including up to 2% of an element chosen from the class consisting of columbium, vanadium, and mixtures thereof.

7. The steel of claim 3, wherein the minimum carbon content is about 0.35%.

8. The steel of claim 3, wherein silicon is restricted to a maximum of about 0.2%.

* * * * *